US009395066B2

(12) United States Patent
Nemeyer

(10) Patent No.: US 9,395,066 B2
(45) Date of Patent: Jul. 19, 2016

(54) ADJUSTABLE BEAM ILLUMINATOR

(75) Inventor: Adam Nemeyer, Cupertino, CA (US)

(73) Assignee: LASER DEVICES, INC., Monterey, CA (US)

( * ) Notice: Subject to any disclaimer, the term of this patent is extended or adjusted under 35 U.S.C. 154(b) by 2 days.

(21) Appl. No.: 13/350,555

(22) Filed: Jan. 13, 2012

(65) Prior Publication Data

US 2013/0182441 A1 Jul. 18, 2013

(51) Int. Cl.

| | |
|---|---|
| ***F21V 14/06*** | (2006.01) |
| ***F21L 4/00*** | (2006.01) |
| *F21Y 101/02* | (2006.01) |

(52) U.S. Cl.

CPC ..... *F21V 14/065* (2013.01); *F21L 4/005* (2013.01); *F21Y 2101/02* (2013.01)

(58) Field of Classification Search

CPC ..... G02B 13/18; G02B 15/14; G02B 15/15; G02B 15/155; F21V 14/005; F21V 14/065

USPC ..... 362/249.02, 311.02, 800, 268, 362/306–307, 310, 372–373, 331, 335

See application file for complete search history.

(56) References Cited

U.S. PATENT DOCUMENTS

| | | | | |
|---|---|---|---|---|
| 4,519,020 | A * | 5/1985 | Little | 362/268 |
| 5,685,105 | A * | 11/1997 | Teetzel | 42/146 |
| 5,816,683 | A * | 10/1998 | Christiansen | 362/110 |
| 6,244,730 | B1 | 6/2001 | Goldberg et al. | |
| 6,414,672 | B2 * | 7/2002 | Rekimoto et al. | 345/173 |
| 6,866,401 | B2 * | 3/2005 | Sommers et al. | 362/268 |
| 7,726,061 | B1 | 6/2010 | Thummel | |
| 8,833,994 | B2 | 9/2014 | Nemeyer | |
| 2005/0254233 | A1 * | 11/2005 | Alessio | 362/169 |
| 2012/0120662 | A1 * | 5/2012 | Duong et al. | 362/268 |
| 2012/0287621 | A1 * | 11/2012 | Lee et al. | 362/231 |
| 2013/0235609 | A1 | 9/2013 | Nemeyer | |

OTHER PUBLICATIONS

Hecht, Optics (ISBN: 0805385665), 4th edition, pp. 171-175, 194-195.*

U.S. Appl. No. 13/784,453 Notice of Allowance dated Jul. 14, 2014.

U.S. Appl. No. 13/784,453 Notice of Allowance dated Jun. 6, 2014.

* cited by examiner

*Primary Examiner* — Sean Gramling

*Assistant Examiner* — Gerald J Sufleta, II

(74) *Attorney, Agent, or Firm* — Innovation Counsel LLP

(57) ABSTRACT

An adjustable beam illuminator may provide a beam of light with an output cone angle that is adjustable (e.g., continuously adjustable) from small output angles (substantially collimated beam, "spot" mode) to larger output angles providing "flood" illumination. The illuminator may emit infrared light, for example.

18 Claims, 5 Drawing Sheets

ADJUSTABLE BEAM ILLUMINATOR

FIELD OF THE INVENTION

The invention relates generally to adjustable beam illuminators that may provide beams of light with output cone angles that are adjustable (e.g., continuously adjustable) from small output angles (substantially collimated beam, "spot" mode) to larger output angles providing "flood" illumination.

BACKGROUND

Adjustable beam illuminators may be used in flood mode to provide illumination by which to inspect a wide area, and then adjusted to collimated ("spot") mode to focus more tightly on anything of interest observed in the inspected area. Such illuminators emitting infrared light may be used in combination with suitable infrared viewing apparatus, for example, to see in the dark. Adjustable beam illuminators may have various hunting, security, and military applications, for example.

SUMMARY

Systems, methods, and apparatus are disclosed by which light emitted from a light source may be formed into a beam with an output cone angle adjustable from a small angle (substantially collimated) to a larger cone angle providing broad area "flood" illumination.

In one aspect, an adjustable beam illuminator comprises a light source, an aperture, a collecting lens having a numerical aperture greater than or equal to about 0.3 and positioned to image the light source through the aperture to produce a beam of collected light, and a collimating lens adjustably positioned along an optical axis of the illuminator. The position of the collimating lens is adjustable between a first position along the optical axis from which the collimating lens images the aperture to provide from the collected beam of light a substantially collimated output beam of light and a second position along the optical axis from which the collimating lens provides from the collected beam of light a diverging flood illumination beam of light.

The light source may be or comprise one or more light emitting diodes (LEDs) such as, for example, infrared emitting LEDs. Alternatively, or in addition, the light source may be or comprise one or more vertical-cavity surface-emitting lasers (VCSELs) such as, for example, infrared emitting VCSELs. The collecting lens may have a numerical aperture greater than or equal to about 0.5, or greater than or equal to about 0.8. The collecting lens may be mounted coaxially with the aperture on a surface in which the aperture is formed. The first position of the collimating lens may be farther from the aperture than is the second position of the collimating lens. The position of the collimating lens may be continuously adjustable between the first position and the second position. The substantially collimated output beam provided when the collimating lens is in the first position may have, for example a cone angle less than or equal to about 2 degrees, and the diverging flood illumination beam provided when the collimating lens is in the second position may have, for example, a maximum cone angle greater than or equal to about 30 degrees. The substantially collimated output beam of light provided when the collimating lens is in the first position and the diverging flood illumination beam of light provided when the collimating lens is in the second position may both have the (e.g., circular) cross-sectional shape of the aperture. The power in the diverging flood illumination output beam provided when the collimating lens is positioned in the second position may be greater than the power in the substantially collimated output beam provided when the collimating lens is in the first position.

In another aspect, an adjustable illuminator comprises a light source, an aperture, a collecting lens positioned to image the light source through the aperture, and a collimating lens adjustably positioned along an optical axis of the illuminator. The position of the collimating lens is adjustable between a first position along the optical axis from which the collimating lens images the aperture to provide from the collected beam of light a substantially collimated output beam of light having the (e.g., circular) cross-sectional shape of the aperture and a second position along the optical axis from which the collimating lens provides from the collected beam of light a diverging flood-illumination beam having the cross-sectional shape of the aperture.

The light source may be or comprise one or more LEDs such as, for example, infrared emitting LEDs. Alternatively, or in addition, the light source may be or comprise one or more VCSELs such as, for example, infrared emitting VCSELs. The collecting lens may have a numerical aperture greater than or equal to about 0.5, or greater than or equal to about 0.8. The collecting lens may be mounted coaxially with the aperture on a surface in which the aperture is formed. The first position of the collimating lens may be farther from the aperture than is the second position of the collimating lens. The position of the collimating lens may be continuously adjustable between the first position and the second position. The substantially collimated output beam provided when the collimating lens is in the first position may have, for example a cone angle less than or equal to about 2 degrees, and the diverging flood illumination beam provided when the collimating lens is in the second position may have, for example, a maximum cone angle greater than or equal to about 30 degrees. The power in the diverging flood illumination output beam provided when the collimating lens is positioned in the second position may be greater than the power in the substantially collimated output beam provided when the collimating lens is in the first position.

Adjustable beam illuminators as disclosed herein may be housed, for example, in combination with lasers (e.g., aiming lasers) to provide devices with both illumination and aiming functions. Such devices may be, for example, hand-held, weapon (e.g., firearm) mounted, or vehicle mounted. Adjustable beam illuminators as disclosed herein may also be housed, for example, in flash-light style housings that may be, for example, hand-held, weapon (e.g., firearm) mounted, or vehicle mounted.

These and other embodiments, features and advantages of the present invention will become more apparent to those skilled in the art when taken with reference to the following more detailed description of the invention in conjunction with the accompanying drawings that are first briefly described.

DETAILED DESCRIPTION

The following detailed description should be read with reference to the drawings, in which identical reference numbers refer to like elements throughout the different figures. The drawings, which are not necessarily to scale, depict selective embodiments and are not intended to limit the scope of the invention. The detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention. As used in this specification and the appended claims, the singular forms "a," "an," and "the" include plural referents unless the context clearly indicates otherwise.

The term "cone angle" as used herein refers to the angle between outer edges of a beam of light, with the "outer edges" of the beam located where the intensity of the beam falls to about 50% of the intensity in the central portion of the beam (i.e., the cone angle corresponds to the full width at half maximum of the beam).

This specification discloses apparatus, systems, and methods by which light emitted from a light source such as a high-power infrared light emitting diode, for example, may be formed into a beam with an output cone angle adjustable from a small angle (substantially collimated) to a larger cone angle providing broad area "flood" illumination. In some variations the beam cone angle may be continuously adjustable between collimated mode and a range of flood modes (e.g., flood modes having a range of cone angles). Alternatively, in other variations the beam cone angle may be discretely adjustable between a collimated mode and one or more particular flood mode cone angles. In flood mode, the output beam may be of substantially uniform intensity within the output cone angle.

In some variations, the output beam may be adjustable from collimated mode to flood mode without changing the cross-sectional shape of the beam, without reducing the power of the beam, or without changing the cross-sectional shape of the beam and without reducing the power of the beam. In some variations, the power in the beam may be greater in flood mode than in collimated mode.

Figure 1A:
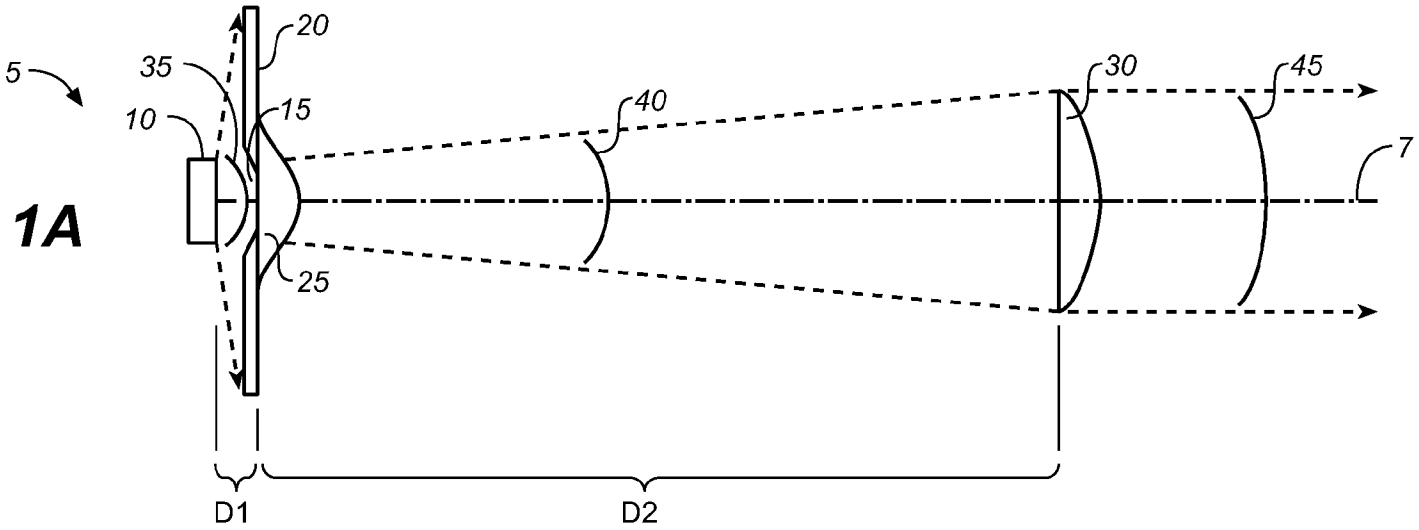
FIGS. 1A and 1B show an optical schematic of an example adjustable beam illuminator with an adjustably positioned collimating lens located in its collimated beam ("spot") mode position (FIG. 1A) and in a large output cone angle ("flood") mode position (FIG. 1B).
Figure 1B:
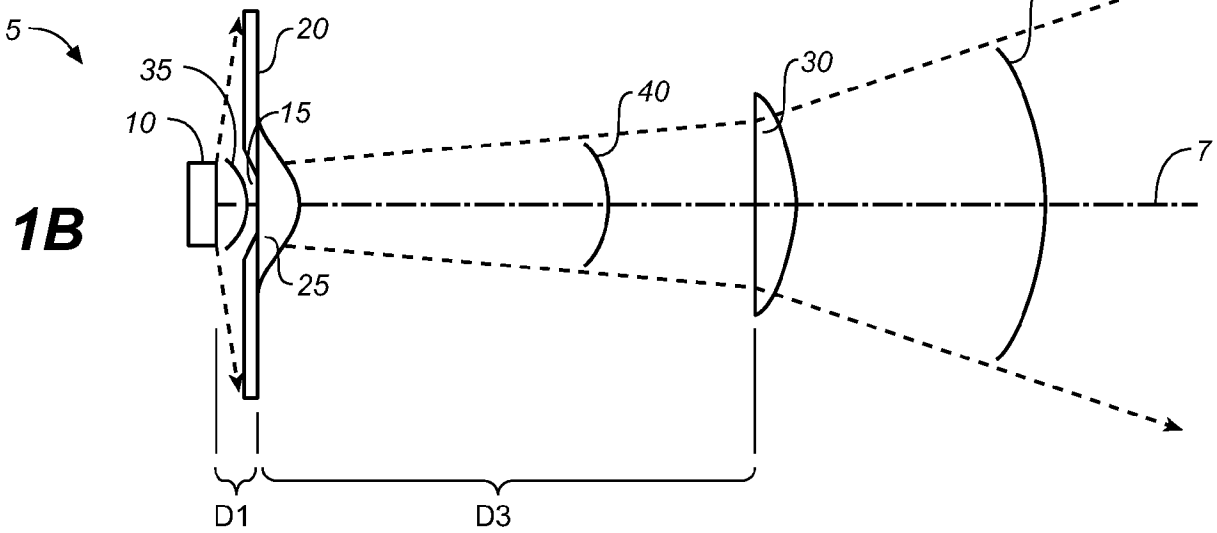

Referring now to FIGS. 1A and 1B, an example adjustable beam illuminator 5 having an optical axis 7 comprises a light source 10, a circular aperture 15 in a lens mount 20, a high numerical aperture collecting lens 25 mounted on lens mount 20 coaxially with aperture 15, and an adjustably positioned collimating lens 30. Light source 10 emits light over a broad cone angle 35 (e.g., a cone angle of about 120°). A central portion of the broad beam emitted by light source 10 passes through aperture 15 into collecting lens 25, but outer portions of the beam emitted by light source 10 are blocked by lens mount 20. Lens mount 20 is positioned so that collecting lens 25 images light source 10 through aperture 15. That is, the back surface (surface closest to the light source) of collecting lens 25 is positioned at a distance D1 from the light source approximately equal to the back-surface focal length of collecting lens 25.

The light beam output by collecting lens 25 is partially collimated, with a cone angle 40 less than the cone angle 35 of light emitted by light source 10. The beam output by collecting lens 25 generally has the cross-sectional shape of the light source, e.g., if the light source is square the beam is generally of square cross-section.

In collimating mode (FIG. 1A), collimating lens 30 is positioned to image circular aperture 15 in lens mount 20. That is, the back surface (surface closest to the aperture) of collimating lens 30 is positioned at a distance D2 from aperture 15 such that the optical path length (through collecting lens 25 and air) from the back surface of the lens to aperture 15 is approximately equal to the back-surface focal length of collimating lens 30. The collimated beam output by collimating lens 30 has a small cone angle 45 less than cone angle 40 of the beam output by collecting lens 25. The collimated beam output by collimating lens 30 generally has the cross-sectional shape of aperture 15, e.g., if aperture 15 is circular the collimated beam is generally of circular cross-section.

In flood mode (FIG. 1B), collimating lens 30 is moved along optical axis 7 from its collimating position to a position at a distance D3<D2 from aperture 15 (i.e., closer to aperture 15 than in collimation mode). As collimating lens 30 is moved from its collimating position toward aperture 15, the cone angle 45 of the beam output by collimating lens 30 increases correspondingly. The inventors have discovered that if collecting lens 25 has a sufficiently high numerical aperture, then the cross-sectional shape of the beam output by collimating lens 30 will have the shape of the aperture (and hence the shape of the collimated beam) for a wide range of such flood mode collimating lens positions. In some variations, a circular cross-section beam shape may be maintained while the cone angle of the beam output by collimating lens 30 is continuously varied from about 2° (collimated) to about 30° by moving collimating lens 30 toward circular aperture 15.

In FIG. 1A and FIG. 1B collimating lens 35 is shown as having a diameter greater than the beam output by collecting lens 25. In other variations, the cone angle of the beam output by collecting lens 25 may be larger than the angle subtended by collimating lens 25 when collimating lens 25 is positioned to provide a collimated beam. In such variations, the amount of light captured by collimating lens 25 may increase as collimating lens 25 is moved toward aperture 15, and the power in the beam output by collimating lens 25 may consequently increase as the output beam is adjusted from collimated to flood mode.

Light source 10 may be, for example, one or more LEDs emitting visible or infrared light, one or more VCSELs (e.g., an array of VCSELs) emitting visible or infrared light, or any other suitable light source. Light source 10 may have any suitable dimensions and shape. In some variations, light source 10 is an infrared or visible light emitting LED having a square, rectangular, or approximately square or rectangular shape with sides of length between about 1.0 millimeters (mm) and about 3.0 mm. Such infrared LEDs may have an output power of, for example, about 1 Watt and emit light at a wavelength of, for example, about 850 nanometers (nm). Such visible light LEDs may have an output power and operating wavelength providing, for example, about 3000 Lumens. LEDs having any other suitable dimensions and output powers may also be used. In some variations, light source 101*s* a VCSEL, or an array of VCSELs, having a square, rectangular or approximately square or rectangular shape with sides of length between about 1.0 mm and about 5.0 mm. Such VCSELs may lase at a wavelength of, for example, about 1500 nm. VCSELs or arrays of VCSELS having any other suitable dimensions may also be used.

Figure 4:
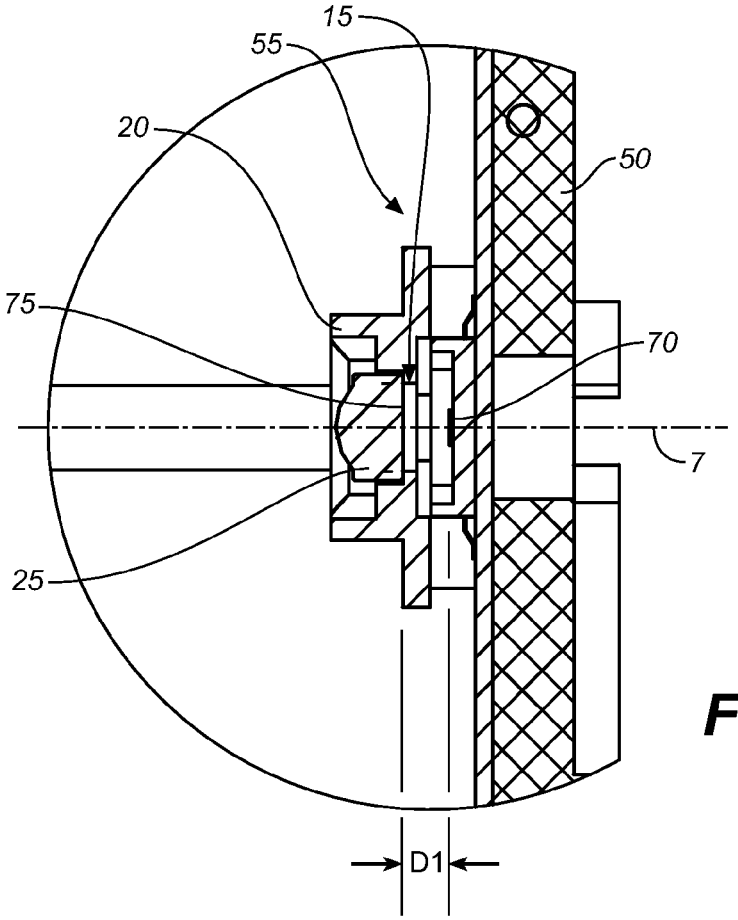
FIG. 4 shows "detail B" from FIG. 2—in cross-section, details of a light emitting diode, aperture, and collecting lens assembly in the adjustable beam illuminator of FIG. 2.

Although the above description refers to aperture 15 as being formed in a surface of a lens mount 20, aperture 15 may be formed in any suitable structure interposed between collecting lens 25 and light source 10. Collecting lens 25 may be mounted on the surface in which aperture 15 is formed (as shown in FIGS. 1A, 1B, and 4) or, optionally, spaced apart from the aperture. Aperture 15 may have a circular shape or any other suitable shape. Some variations may employ apertures having the shape of a polygon having any suitable number of sides, for example. Other variations may employ apertures having elliptical shapes, for example.

When circular, aperture 15 may have a diameter of, for example, about 2.0 mm, about 1.0 mm to about 3.0 mm, or any other suitable diameter. Non-circular apertures may have, for example, largest dimensions of about 2.0 mm, about 1.0 mm to about 3.0 mm, or any other suitable size. The size of the aperture may be selected, for example, to transmit about 90%, or about 85% to about 95%, of light emitted by light source 10.

Collecting lens 25 may have a numerical aperture (NA) of, for example, ≥0.3, ≥0.5, ≥0.7, or ≥0.8, and a diameter of, for example, about 3.0 mm, or of about 2.0 mm to about 5.0 mm. Collecting lens 25 may be an aspheric lens, for example.

Collimating lens 30 may have a focal length of, for example, about 50 mm, or of about 10 mm to about 100 mm, and a diameter of, for example, about 25 mm or of about 10 mm to about 75 mm. Collimating lens 30 may be an achromatic doublet, for example. Lens 30 may be mounted on any suitable mount allowing the position of lens 30 to be varied continuously, or in discrete increments, to vary the output beam cone angle from collimated mode to flood mode. From its collimating position, lens 30 may be moved toward aperture 15, for example, about 25 mm, or about 2.5 mm to about 50 mm, to increase the output beam cone angle for flood mode illumination.

Figure 2:
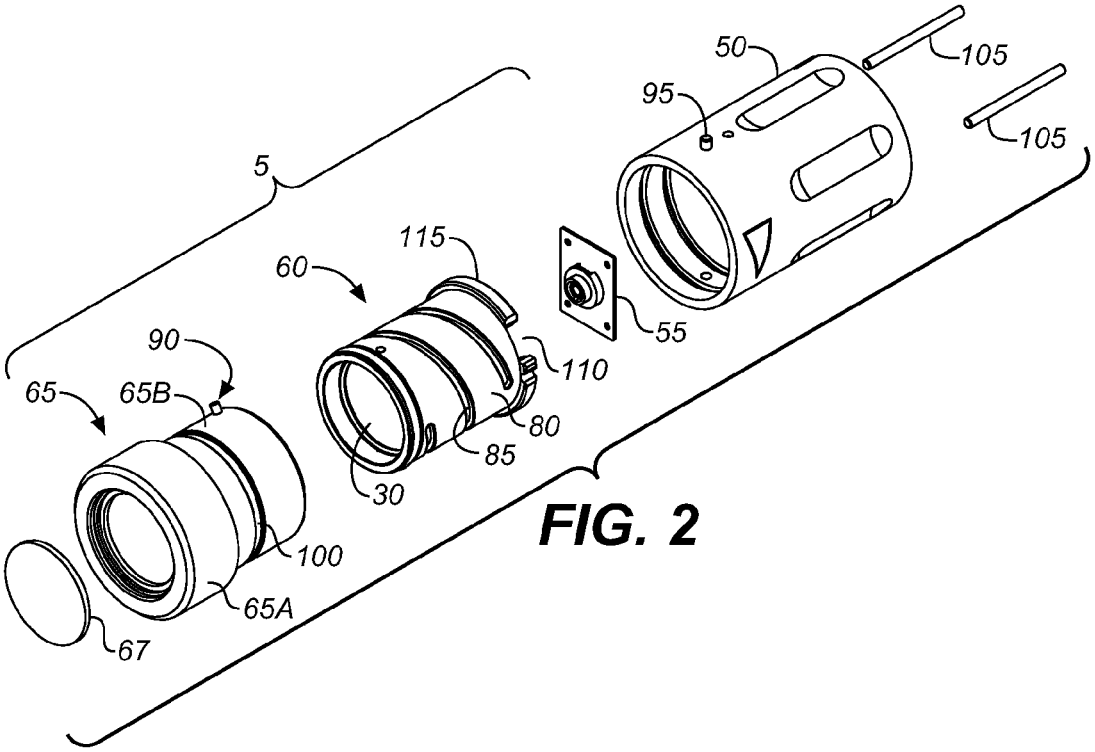
FIG. 2 shows an exploded view of an example adjustable beam illuminator having a focusing mechanism that adjusts the position of a collimating lens in the illuminator without altering the length of the housing enclosing the illuminator.

Adjustable beam illuminator 5 may optionally include one or more optical filters positioned in the output beam after collimating lens 30 (see FIG. 2, for example). An adjustable beam illuminator intended to provide an infrared output beam, for example, may employ a long-pass infrared filter after collimating lens 30 to minimize the amount of any visible light output from the illuminator.

Generally, any suitable combination of the light sources, apertures, collecting lenses, and collimating lenses described above may be used in adjustable beam illuminator 5. For example, in some variations light source 10 is a square infrared LED having side lengths of about 1.0 mm and emitting about 1.0 Watt of infrared light with a bandwidth of about 40 run centered at about 850 nm, aperture 15 is a circular aperture having a diameter of about 2.0 mm formed in aluminum of about 0.4 mm thickness with polished and anodized knife edges defining the aperture, collecting lens 25 is an aspheric lens with a diameter of about 3 mm and an NA of about 0.5, collecting lens 25 is mounted coaxially with the aperture on the surface in which the aperture is formed and positioned to image the LED through the aperture, collimating lens 30 is an achromatic doublet with a diameter of about 25 mm and a focal length of about 50 mm, and the position of collimating lens 30 along optical axis 7 is continuously adjustable over a distance of about 25 mm from a position about 50 mm from aperture 15 to a position about 25 mm from aperture 15 to vary the output beam from collimated mode to flood mode, respectively. In these variations, the output beam retains a circular cross section over the length of travel of collimating lens 30, and the output beam power increases as its cone angle is increased on entering flood mode. The collimated beam has a cone angle of about 2° when collimating lens 25 is at its position farthest from aperture 15, and the flood beam has a cone angle of about 30° when collimating lens 25 is at its closest position to aperture 15.

Referring now to FIGS. 2, 3A-3B, and 4, in some variations of adjustable beam illuminator 5 the position of collimating lens 25 may be continuously adjusted without altering the length of the illuminator. The variation illustrated in these figures comprises a housing 50, a light source assembly 55, a focusing assembly 60, an adjusting ring 65, and an optional infrared long-pass filter 67 fitted into an outer end of adjusting ring 65.

Referring now to FIG. 4, light source assembly 55 comprises an infrared LED 70, a lens holder 20 including an aperture 15, and a collecting lens 25 positioned in lens holder 20 with its back surface 75 in contact with the surface in which aperture 15 is formed and positioned a distance D1 from the front surface of LED 70. Light source assembly 55 is mounted to a back inside wall of housing 50.

Figure 3A:
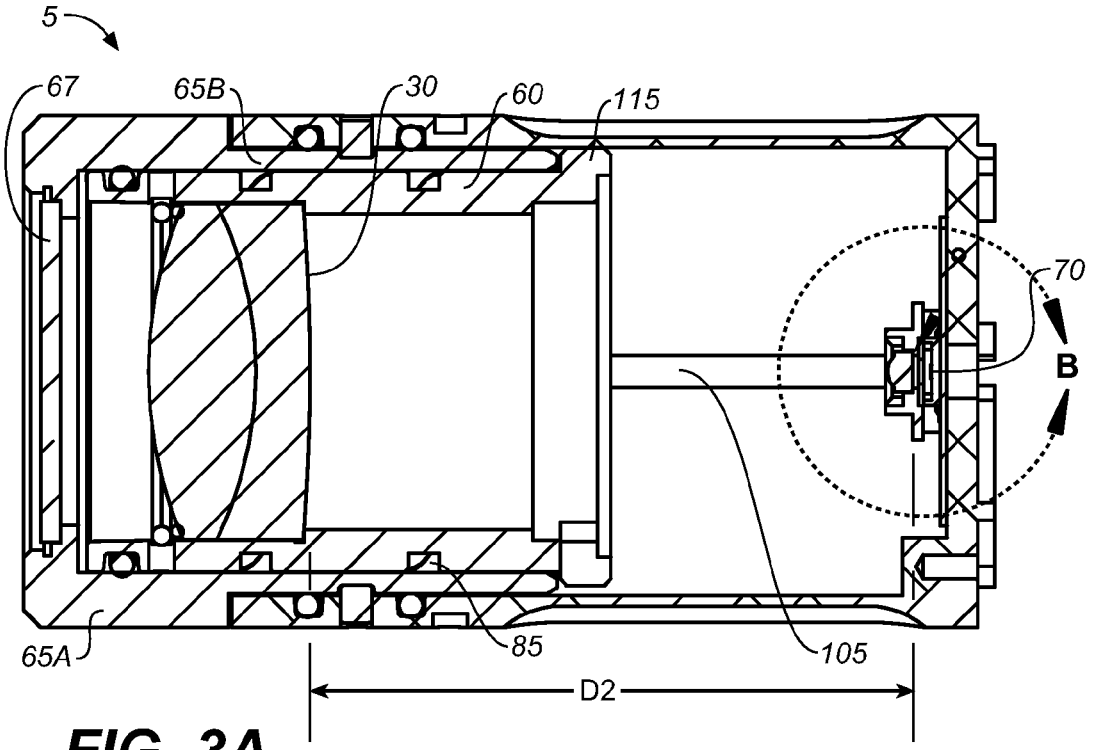
FIGS. 3A and 3B show cross-sections of a portion of the illuminator of FIG. 2, with the collimating lens positioned for collimating mode (FIG. 3A) and at a "flood" mode position (FIG. 3B).
Figure 3B:
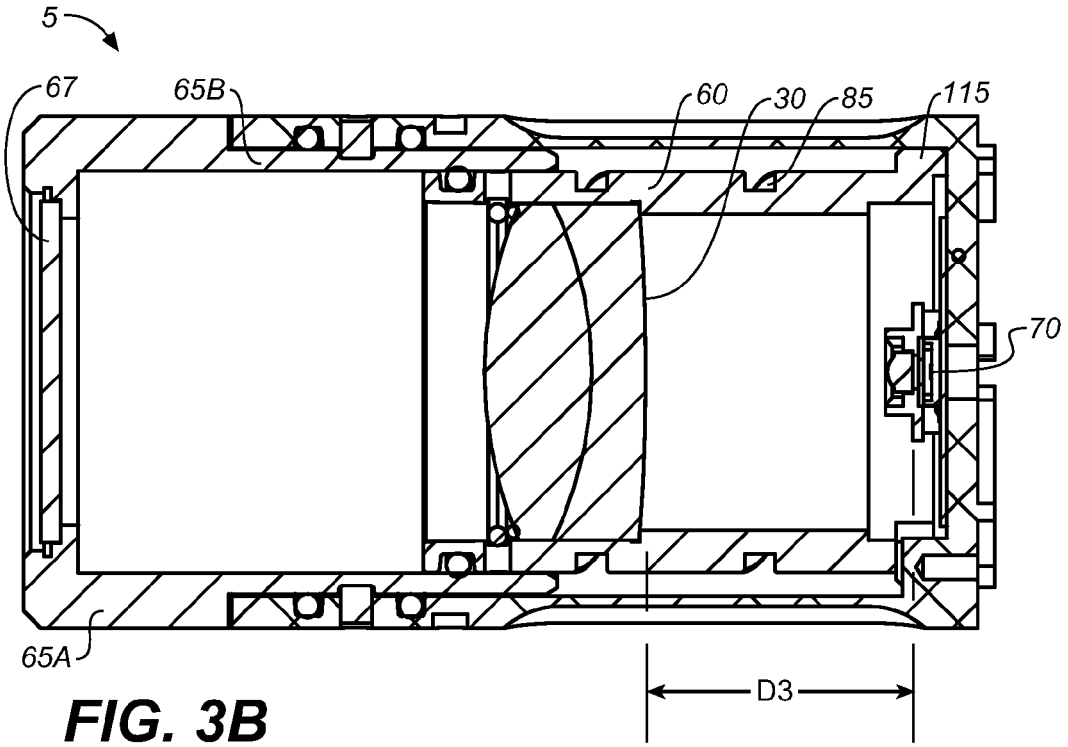

Referring again to FIG. 2 and to FIGS. 3A-3B, focusing assembly 60 includes a hollow tube 80 with a spiral groove 85 in its outer surface. Collimating lens 30 is fixed in position in a front portion of tube 80. Adjusting ring 65 has the form of a hollow tube having a first outer diameter at a front portion 65A and a second outer diameter, smaller than the first diameter, at a rear portion 65B. The outer diameter of focusing assembly 60 is sized so that focusing assembly 60 may be positioned within adjusting ring 65. One or more pins 90 may then be inserted through one or more holes in the rear portion 65B of adjusting ring 65 to engage groove 85 in focusing assembly 60.

The diameters of adjusting ring front portion 65A and of rear portion 65B are sized to allow adjusting ring rear portion 65B to be inserted into housing 50 until stopped by contact between adjusting ring front portion 65B and housing 50. One or more pins 95 may then be inserted through a front portion of housing 50 to engage a cylindrical groove 100 in adjusting ring rear portion 65B to retain adjusting ring rear portion 65B within housing 50 while allowing rotation of adjusting ring 65 about optical axis 7. Pins 105 inserted through the back wall of housing 50 engage notches 110 in flange 115 of focusing assembly 60, or engage other features on focusing assembly 60, to prevent focusing assembly 60 from rotating about optical axis 7 while allowing focusing assembly 60 to translate forward and backward along optical axis 7.

When thus assembled, rotation of adjusting ring 65 causes pins 90 engaging spiral groove 85 to exert a force on focusing assembly 60 that moves focusing assembly 60 forward or backward along optical axis 7, depending on the direction in which adjusting ring 65 is rotated. The end point for forward motion of focusing assembly 60 may be determined by contact between flange 110 and adjusting ring end portion 65B. The end point of backward motion of focusing assembly 60 may be determined by contact between flange 110 and the rear wall of housing 50.

Figure 5:
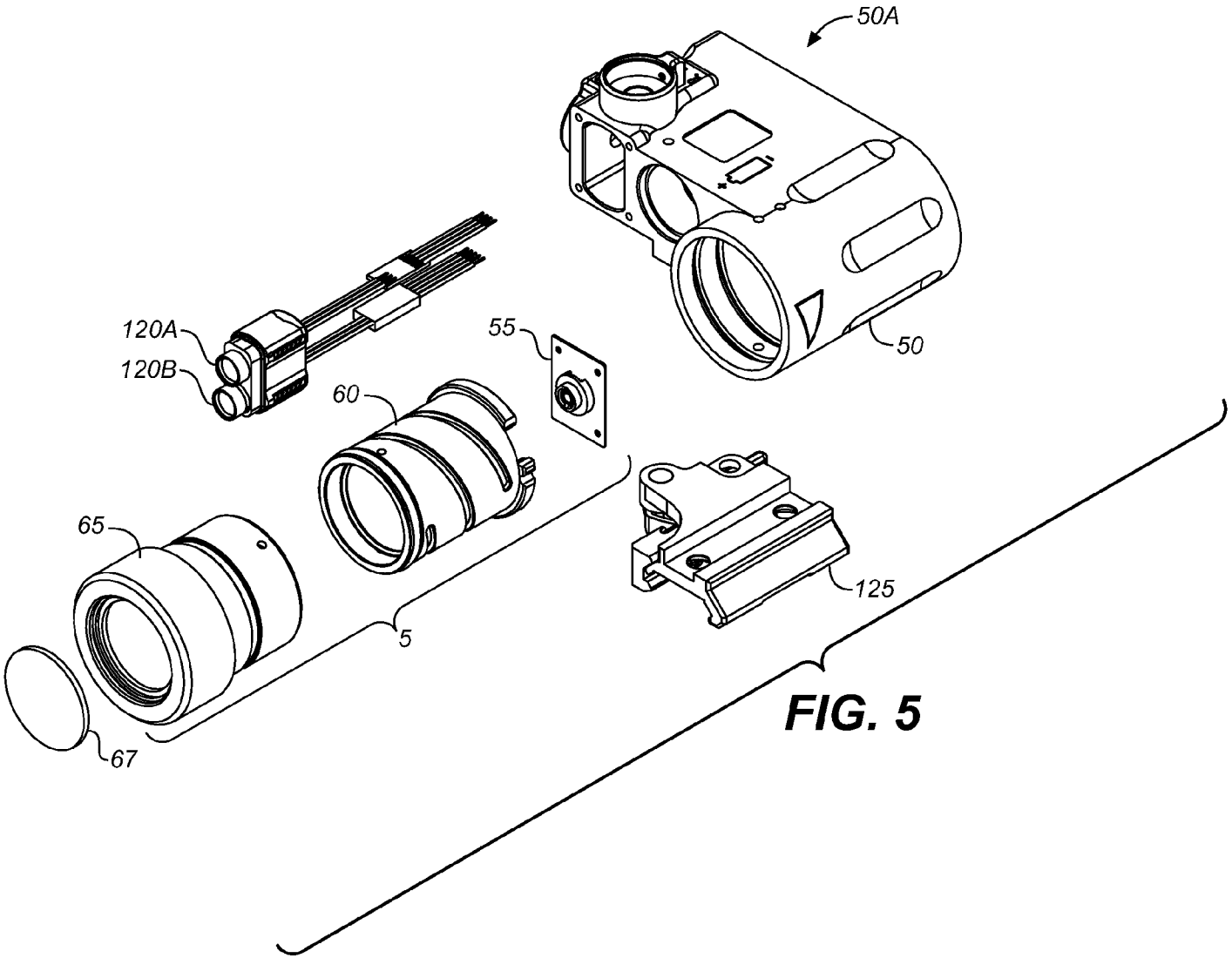
FIG. 5 shows an exploded view of the adjustable beam illuminator of FIG. 2 in a housing in combination with two aiming lasers.

Referring now to FIG. 5, in some variations an adjustable beam illuminator may be combined with one or more lasers to provide a device having illumination and laser aiming functions, for example. In the variation illustrated in FIG. 5, the adjustable beam illuminator of FIG. 2 is combined with lasers 120A and 120B in a housing 50A, of which housing 50 of FIG. 2 forms a part. Lasers 120A and 120B may be respectively, for example, a visible light laser lasing at about 635 nanometers with an output power of about 5 milliwatts and an infrared laser lasing at about 850 nm with an output power of about 0.7 milliwatts. Any other suitable type or number of lasers may be used instead. Optional mount 125 may be used to mount housing 50A to, for example, a firearm or other weapon to be aimed, to a vehicle, or to some other object (not shown). Mount 125 may optionally include adjustment mechanisms (e.g., screws) allowing the orientation of housing 50A to be adjusted with respect to whatever object it is mounted to. Housing 50A may include adjustment mechanisms (e.g., screws) allowing the orientation of lasers 120A and 120B to be adjusted with respect to housing 50A. Housing 50A may comprise batteries or some other power source for adjustable beam illuminator 5 and lasers 120A and 120B.

Figure 6:
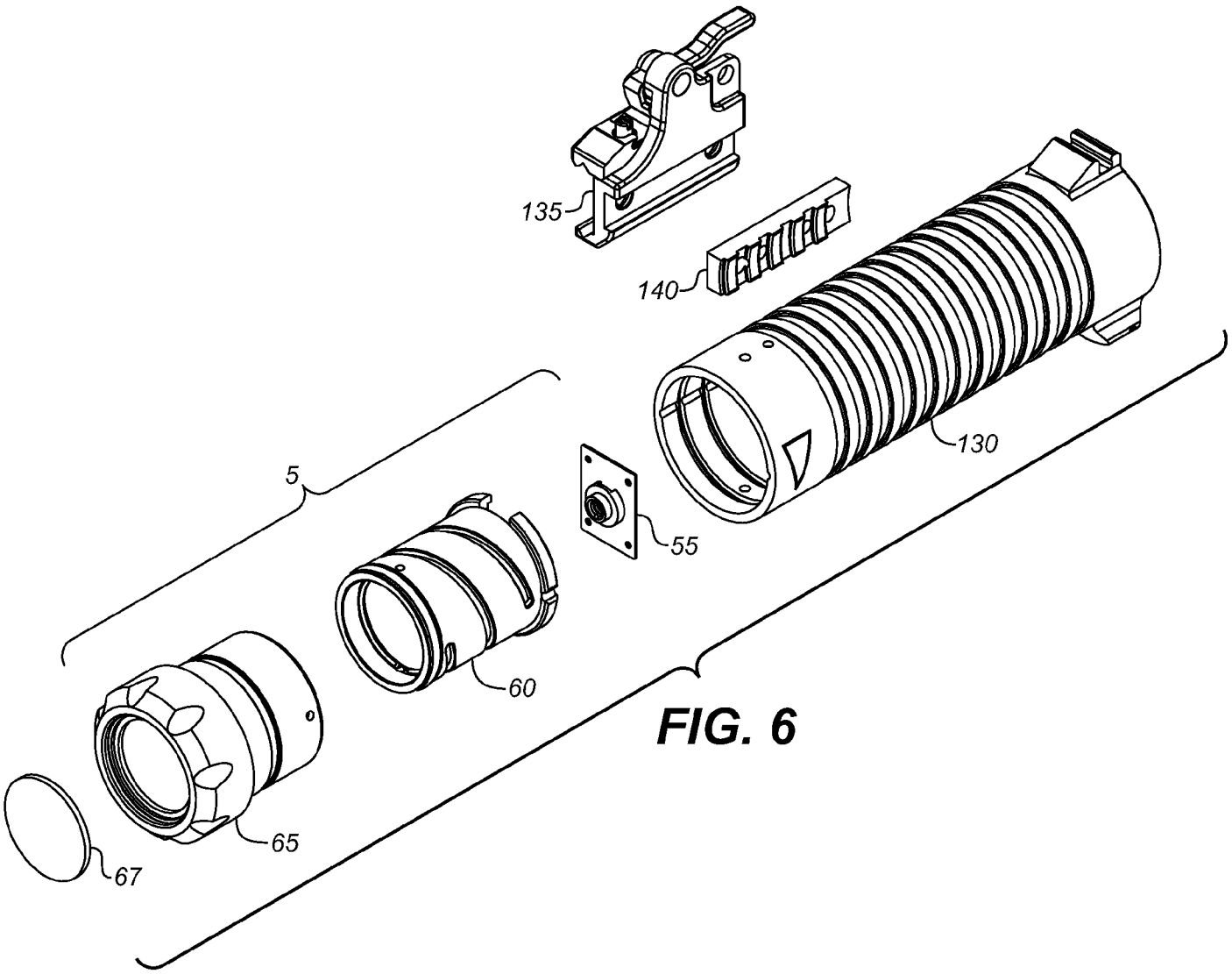
FIG. 6 shows an exploded view of the adjustable beam illuminator of FIG. 2 in a flash-light style housing.

Referring now to FIG. 6, in some variations an adjustable beam illuminator may be housed in a flash-light style housing. In the illustrated example, flash-light style housing 130 is substituted for housing 50 of FIG. 2. Housing 130 may be hand-held. Alternatively, optional mount 135, attached to housing 50 with adapter 140, may be used to mount housing 130 to, for example, a firearm or other weapon, a vehicle, or some other object (not shown). Mount 135 may optionally include adjustment mechanisms (e.g., screws) allowing the orientation of housing 130 to be adjusted with respect to whatever object it is mounted to. Housing 130 may comprise batteries or some other power source for adjustable beam illuminator 5.

This disclosure is illustrative and not limiting. Further modifications will be apparent to one skilled in the art in light of this disclosure and are intended to fall within the scope of the appended claims.

What is claimed is:

1. An adjustable beam illuminator comprising:

a light emitting diode having a cross-sectional shape;

an aperture formed in a surface and having a cross-sectional shape different from that of the light emitting diode, wherein the aperture transmits a central portion of a beam of light emitted by the light emitting diode, and outer portions of the beam from the light emitting diode are blocked;

an aspheric collecting lens mounted on the surface in which the aperture is formed, the aspheric collecting lens having a numerical aperture greater than or equal to about 0.5, and positioned to image the light emitting diode through the aperture to produce a beam of collected light having a cross-sectional shape approximately the same as that of the light emitting diode, the aspheric collecting lens positioned a distance from the light emitting diode that is equal to the focal length of the side of the aspheric collecting lens that faces the light emitting diode, wherein the aspheric collecting lens is larger than the aperture; and a collimating lens adjustably positioned along an optical axis of the illuminator, the position of the collimating lens adjustable between a first position along the optical axis from which the collimating lens provides from the collected beam of light a substantially collimated output beam of light having a cross-sectional shape approximately the same as that of the aperture and a second position along the optical axis from which the collimating lens provides from the collected beam of light a diverging flood illumination beam of light also having a cross-sectional shape approximately the same as that of the aperture.

2. The adjustable beam illuminator of claim 1, wherein the light emitting diode emits infrared light.

3. The adjustable beam illuminator of claim 1, wherein the aspheric collecting lens has a numerical aperture greater than or equal to about 0.8.

4. The adjustable beam illuminator of claim 1, wherein the aspheric collecting lens is mounted coaxially with the aperture on the surface in which the aperture is formed.

5. The adjustable beam illuminator of claim 1, wherein the first position of the collimating lens is farther from the aperture than is the second position of the collimating lens.

6. The adjustable beam illuminator of claim 1, wherein the position of the collimating lens is continuously adjustable between the first position and the second position.

7. The adjustable beam illuminator of claim 1, wherein the substantially collimated output beam provided when the collimating lens is in the first position has a cone angle less than or equal to about 2 degrees, and the diverging flood illumination beam provided when the collimating lens is in the second position has a cone angle greater than or equal to about 30 degrees.

8. The adjustable beam illuminator of claim 1, wherein the power in the diverging flood illumination output beam provided when the collimating lens is positioned in the second position is greater than the power in the substantially collimated output beam provided when the collimating lens is in the first position.

9. The adjustable beam illuminator of claim 1, wherein:

the light emitting diode is an infrared light emitting diode;

the position of the collimating lens is continuously adjustable between the first position and the second position; and the first position of the collimating lens is farther from the aperture than is the second position of the collimating lens.

10. The adjustable beam illuminator of claim 9, wherein the power in the diverging flood illumination output beam provided when the collimating lens is positioned in the second position is greater than the power in the substantially collimated output beam provided when the collimating lens is in the first position.

11. The adjustable beam illuminator of claim 9, wherein the substantially collimated output beam provided when the collimating lens is in the first position has a cone angle less than or equal to about 2 degrees, and the diverging flood illumination beam provided when the collimating lens is in the second position has a cone angle greater than or equal to about 30 degrees.

12. The adjustable beam illuminator of claim 11, wherein the power in the diverging flood illumination output beam provided when the collimating lens is positioned in the second position is greater than the power in the substantially collimated output beam provided when the collimating lens is in the first position.

13. The adjustable beam illuminator of claim 1, arranged in a housing configured for mounting to a firearm.

14. The adjustable beam illuminator of claim 13, sharing the housing with an aiming laser.

15. The adjustable beam illuminator of claim 9, arranged in a housing configured for mounting to a firearm.

16. The adjustable beam illuminator of claim 15, sharing the housing with an aiming laser.

17. The adjustable beam illuminator of claim 9, wherein the aspheric collecting lens is mounted coaxially with the aperture on the surface in which the aperture is formed.

18. The adjustable beam illuminator of claim 11, wherein the aspheric collecting lens is mounted coaxially with the aperture on the surface in which the aperture is formed.

* * * * *